United States Patent [19]

Griffin

[11] Patent Number: 4,986,577

[45] Date of Patent: Jan. 22, 1991

[54] SECURITY LOCK MECHANISM

[76] Inventor: Elon Griffin, Rte. 3, Box 464 A-1, Byhalia, Miss. 38611

[21] Appl. No.: 330,782

[22] Filed: Mar. 30, 1989

[51] Int. Cl.[5] ..... E05C 9/00

[52] U.S. Cl. ..... 292/48; 292/201

[58] Field of Search ..... 292/45, 48, 201, 144, 292/DIG. 31, 167; 49/394; 180/68.1; 89/36.08

[56] References Cited

U.S. PATENT DOCUMENTS

| | | | |
|---|---|---|---|
| 1,182,885 | 5/1916 | Bellamore | 89/36.08 |
| 1,501,790 | 7/1924 | McClay et al. | 89/36.08 |
| 2,505,401 | 4/1950 | Ingres et al. | 49/394 |
| 2,506,851 | 5/1950 | Ayers, Jr. | 49/394 |
| 2,640,723 | 6/1953 | Lauer et al. | 296/37 |
| 2,700,174 | 1/1955 | Troche | 49/394 |
| 3,400,961 | 9/1968 | Koch et al. | 292/216 |
| 3,432,198 | 3/1969 | Connor | 292/216 |
| 3,525,545 | 8/1970 | Leslie | 292/216 |
| 3,583,742 | 6/1971 | Kwasiborski, Jr. | 292/216 |
| 3,666,308 | 5/1972 | Bonnaud | 292/336.3 |
| 3,834,747 | 9/1974 | Slovensky, Jr. | 292/38 |
| 4,186,817 | 2/1980 | Bauer | 180/68.1 |
| 4,273,368 | 7/1981 | Tanaka | 292/48 X |
| 4,371,205 | 2/1983 | Kaveney, Jr. | 292/48 |
| 4,519,227 | 5/1985 | Dumbser | 70/264 |
| 4,708,193 | 1/1973 | Caporicci | 292/280 |

*Primary Examiner*—Gary L. Smith
*Assistant Examiner*—Michael J. Milano
*Attorney, Agent, or Firm*—Walker & McKenzie

[57] ABSTRACT

A security lock mechanism for locking first and second structures to one another to define a controlled space on one side of the structures and for requiring the simultaneous efforts of two persons to unlock the mechanism from locations outside the controlled space. The mechanism includes a first and second latch members attached to the first structure; first latch mechanism attached to the second structure for being locked to the first latch member; second latch mechanism attached to the second structure for being locked to the second latch member; and control strucutre for unlocking the latch mechanisms from the latch members; the control structure inlcuding adjacent control structure for being activated from a location adjacent but outside the controlled space and including remote control structure for being activated from a location remote from the controlled space; the control structure unlocking the latch mechanisms from the latch members only if the adjacent and remote control structures are activated simultaneously.

8 Claims, 3 Drawing Sheets

SECURITY LOCK MECHANISM

BACKGROUND OF THE INVENTION

1. Field of the Invention

The present invention relates, in general, to a security lock mechanism for locking first and second structures to one another.

2. Information Disclosure Statement

A preliminary patentability search in class 292, subclasses 92, 48, 216, 201, and Digests 3, 31, 23, class 70, subclasses 92, 238, 279, 465 and Digests 63 and 65 produced the following patents which may be relevant to the present invention: Lauer et al, U.S. Pat. No. 2,640,723; Koch et al, U.S. Pat. No. 3,400,961; Connor, U.S. Pat. No. 3,432,198; Leslie, U.S. Pat. No. 3,525,545; Kwasiborski, U.S. Pat. No. 3,583,742, Bonnaud, U.S. Pat. No. 3,666,308; Caporicci, U.S. Pat. No. 3,708,193; Slovensky, U.S. Pat. No. 3,834,747; Kaveney, U.S. Pat. No. 4,371,205; and Dumbser et al, U.S. Pat. No. 4,519,227. None of the above patents disclose or suggest the present invention.

The inventor is aware of prior armored vehicles used for the delivery of large sums of money to and from banks and the like that include security lock mechanisms for the delivery door of the vehicle, the security lock mechanism having a key operated lock means for use by a delivery person delivering money to or from the vehicle and a remote controlled lock means operated by the driver of the vehicle whereby the actions of two different persons are required to gain access through the delivery door. One problem with such security lock mechanisms is the possibility of leaving either the key operated lock means or the remote control lock means open, whereby one person can then open the delivery door.

SUMMARY OF THE INVENTION

The present invention is directed toward providing an improved security lock mechanism. The concept of the present invention is to provide a security lock mechanism which requires the simultaneous efforts of two persons to unlock.

A security lock mechanism of the present invention is used for locking first and second structures to one another to define a controlled space on one side of the first and second structures and for requiring the simultaneous efforts of two persons to unlock the security lock mechanism from locations outside the controlled space. The mechanism of the present invention includes a first latch member attached to the first structure; a second latch member attached to the first structure; first latch means attached to the second structure for being locked to the first latch member; second latch means attached to the second structure for being locked to the second latch member; and control means for unlocking the first and second latch means from the first and second latch members; the control means including adjacent control means for being activated from a location adjacent but outside the controlled space and including remote control means for being activated from a location remote from the controlled space; the control means unlocking the first and second latch means from the first and second latch members only if the adjacent and remote control means are activated simultaneously.

DESCRIPTION OF THE PREFERRED EMBODIMENT

Figure 1:
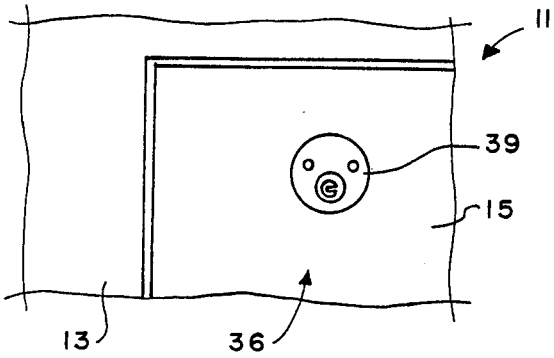
FIG. 1 is a front elevational view of a portion of the security lock mechanism of the present invention showing a portion of the first and second structures in a closed position.

The security lock mechanism 11 of the present invention is for locking a first structure 13 such as a door jamb to a second structure 15 such as a door to define a controlled space 17 on one side of the first and second structures 13, 15 (e.g., on the inside of a door and door jamb) and for requiring the simultaneous efforts of two persons to unlock the first and second structures 13, 15 relative to one another from locations outside the controlled space 17. The lock mechanism 11 is specifically designed for use on the side or rear doors of armored vehicles used to carry large quantities of money as will now be apparent to those skilled in the art. For example, each latch member 19, 21 may consist of a model 400-52 ZNST manufactured by Eberhard Mfg. Co. of 21944 Drake Rd., Cleveland, Ohio 44136.

Figure 2:
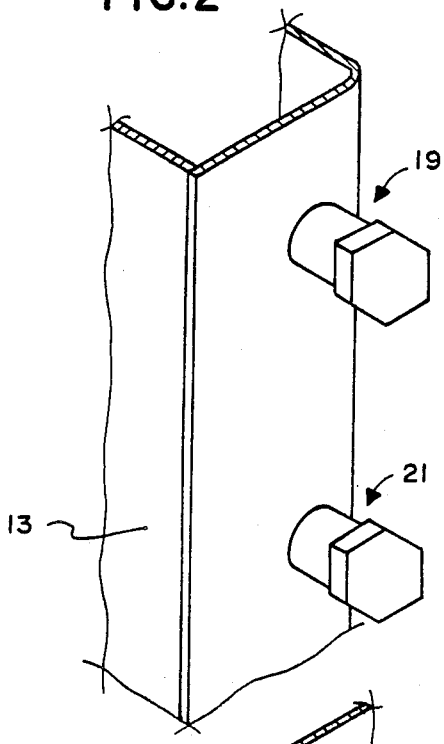
FIG. 2 is a perspective view of a portion of the security lock mechanism of the present invention showing a portion of the first structure and first and second latch members.

The lock mechanism 11 includes a first latch member 19 attached to the first structure 13 and a second latch member 21 attached to the first structure 13, preferably spaced slightly below the first latch member 19 as clearly shown in FIG. 2. The first and second latch members 19, 21 preferably consist of bolt-like members fixedly mounted on the side of a door jamb of an armored vehicle as will now be apparent to those skilled in the art.

The lock mechanism 11 includes first latch means 23 attached to the second structure 15 for being locked to the first latch member 19 and second latch means 25 attached to the second structure 15 for being locked to the second latch member 21. The first latch means 23 preferably includes a body 27 attached to the second structure 15 by bolts or the like (not shown) and preferably includes latch arm means 29 pivotally attached to the body 27 for movement between a completely locked position in which the first latch means 23 is locked to the first latch member 19 and a completely unlocked position in which the first latch means 23 is free from the first latch member 19. The latch arm means 29 preferably includes a trigger portion 30 pivotally attached to a tab portion of the body 27 by a pivot pin 31 or the like. The second latch means 25 preferably includes a body 32 attached to the second structure 15 by bolts or the like (not shown) and preferably includes latch arm means 33 pivotally attached to the body 32 for movement between a completely locked position in which the second latch means 25 is locked to the second latch member 21 and a completely unlocked position in which the second latch means 25 is free from the second latch member 21. The latch arm means 33 preferably includes a trigger portion 34 pivotally attached to a tab portion of the body 32 by a pivot pin 35 or the like. The latch means 23, 25 are preferably of the type that will prevent movement thereof relative to the latch members 19, 21 when in the completely locked positions and that require some movement thereof away from the latch members 19, 21 while moving to the completely unlocked position. Such a combination will require that both latch means 23, 25 be moved simultaneously to the fully unlocked or open position as will now be apparent to those skilled in the art. The specific construction and operation of the latch means 23, 25 may vary as will now be apparent to those skilled in the art. Preferably, each latch means 23, 25 consist of a model 1-400 ZNRH (for right hand doors) or a model 1-400 ZNLH (for left hand doors), manufactured by Eberhard Mfg. Co. of 21944 Drake Rd., Cleveland, Ohio 44136, and attached to the second structure 15 adjacent and aligned with one another as clearly shown in FIG. 4.

The lock mechanism 11 includes control means for unlocking the first and second latch means 23, 25 from the first and second latch members 19, 21. The control means includes adjacent control means 36 for being activated from a location adjacent but outside the controlled space 17 and including remote control means 37 for being activated from a location remote from the controlled space 17. The control means unlocks the first and second latch means 23, 25 from the first and second latch members 19, 21 only if the adjacent and remote control means 36, 37 are activated simultaneously.

Figure 6:
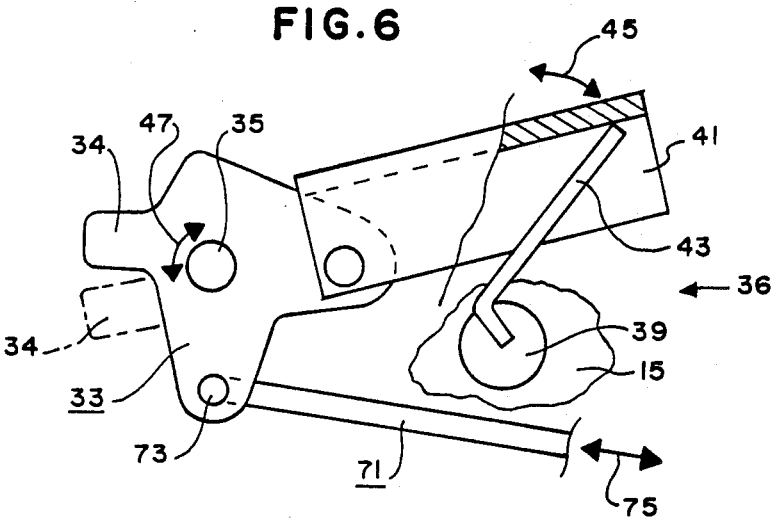
FIG. 6 is a somewhat diagrammatic elevational view of a portion of the security lock mechanism of the present invention showing a portion of the adjacent control means.

The adjacent control means 36 preferably includes a key operated lock 39 coupled to the latch arm means 33 of the second latch means 25 for being activated from a position adjacent but outside the controlled space 17 and for causing the latch arm means 33 of the second latch means 25 to move between the completely locked position and the completely unlocked position. The adjacent control means 36 preferably includes an extension arm member 41 coupled to the latch arm means 33 of the second latch means 25 and preferably includes a flapper member 43 coupled to the key operated lock 39 and the extension arm member 41 thereof as clearly shown in FIG. 6. Operation of the key operated lock 39 will cause the flapper member 43 to pivot in the direction of the arrow 45 in FIG. 6 between a first position and a second position. Pivotal movement of the flapper member 43 to the second position will cause the extension arm member 41 of the adjacent control means 36 to also move generally in the direction of the arrow 45 in FIG. 6 between a first position and a second position. Movement of the extension arm member 41 of the adjacent control means 36 to the second position will cause the latch arm means 33 of the second latch means 25 to move to the completely unlocked position. More specifically, movement of the extension arm member 41 generally in the direction of the arrow 45 in FIG. 6 will cause the trigger portion 34 of the latch arm means 33 of the second latch means 25 to pivot in the direction of the arrow 47 in FIG. 6 as will now be apparent to those skilled in the art.

Figure 4:
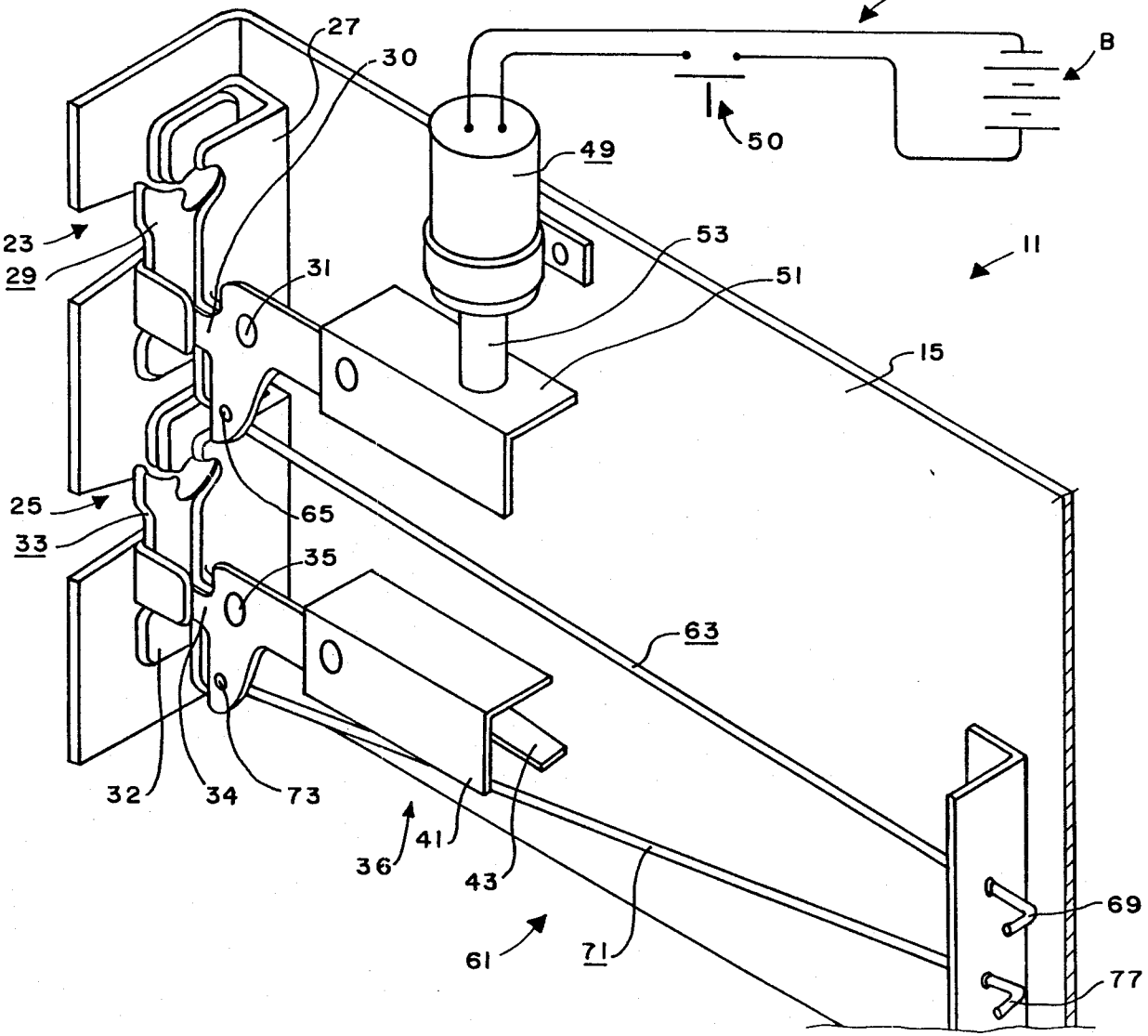
FIG. 4 is a somewhat diagrammatic perspective view of the security lock mechanism of the present invention showing a portion of the second structure, the first and second latch means, and the control means.
Figure 7:
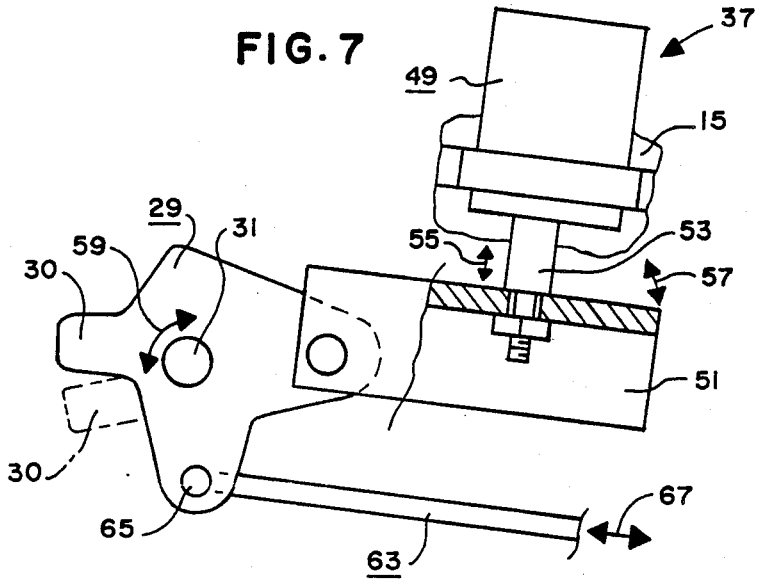
FIG. 7 is a somewhat diagrammatic elevational view of a portion of the security lock mechanism of the present invention showing a portion of the remote control means.
Figure 8:
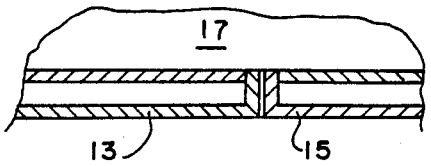
FIG. 8 is a somewhat diagrammatic sectional view of the first and second structures locked to one another by the security lock mechanism of the present invention.

The remote control means 37 of the control means preferably includes a solenoid means 49 coupled to the latch arm means 29 of the first latch means 23 for being activated from a position remote from the controlled space 17 and for causing the latch arm means 29 of the first latch means 23 to move between the completely locked position and the completely unlocked position. The solenoid means 49 is preferably electrically coupled to a battery B or other source of electrical energy as shown in FIG. 4. The remote control means 37 preferably includes a switch 50 in the electrical circuit between the solenoid means 49 and the battery B as shown in FIG. 4 for allowing the solenoid means 49 to be activated. The switch 50 is positioned remote from the controlled space 17. Preferably, the switch 50 may be positioned within the cab of an armored vehicle or the like. The remote control means 37 preferably includes an extension arm member 51 coupled to the latch arm means 29 of the first latch means 23. The solenoid means 49 of the remote control means 37 preferably includes a rod member 53 coupled to the extension arm member 51 thereof as clearly shown in FIG. 7. Operation of the solenoid means 49 will cause the rod member 53 thereof to move in the direction of the arrow 55 in FIG. 7 between a first position and a second position. Movement of the rod member 53 of the solenoid means 49 to the second position will cause the extension arm member 51 of the remote control means 37 to move in the direction of the arrow 57 in FIG. 7 between a first position and the second position. Movement of the extension arm member 51 of the remote control means 37 to the second position will cause the latch arm means 29 of the first latch means 23 to move to the completely unlocked position. More specifically, movement of the extension arm member 51 in the direction of the arrow 57 in FIG. 7 will cause the trigger portion 30 of the latch arm means 29 of the first latch means 23 to pivot in the direction of the arrow 59 in FIG. 7 between the completely locked and completely unlocked positions as will now be apparent to those skilled in the art.

Figure 3:
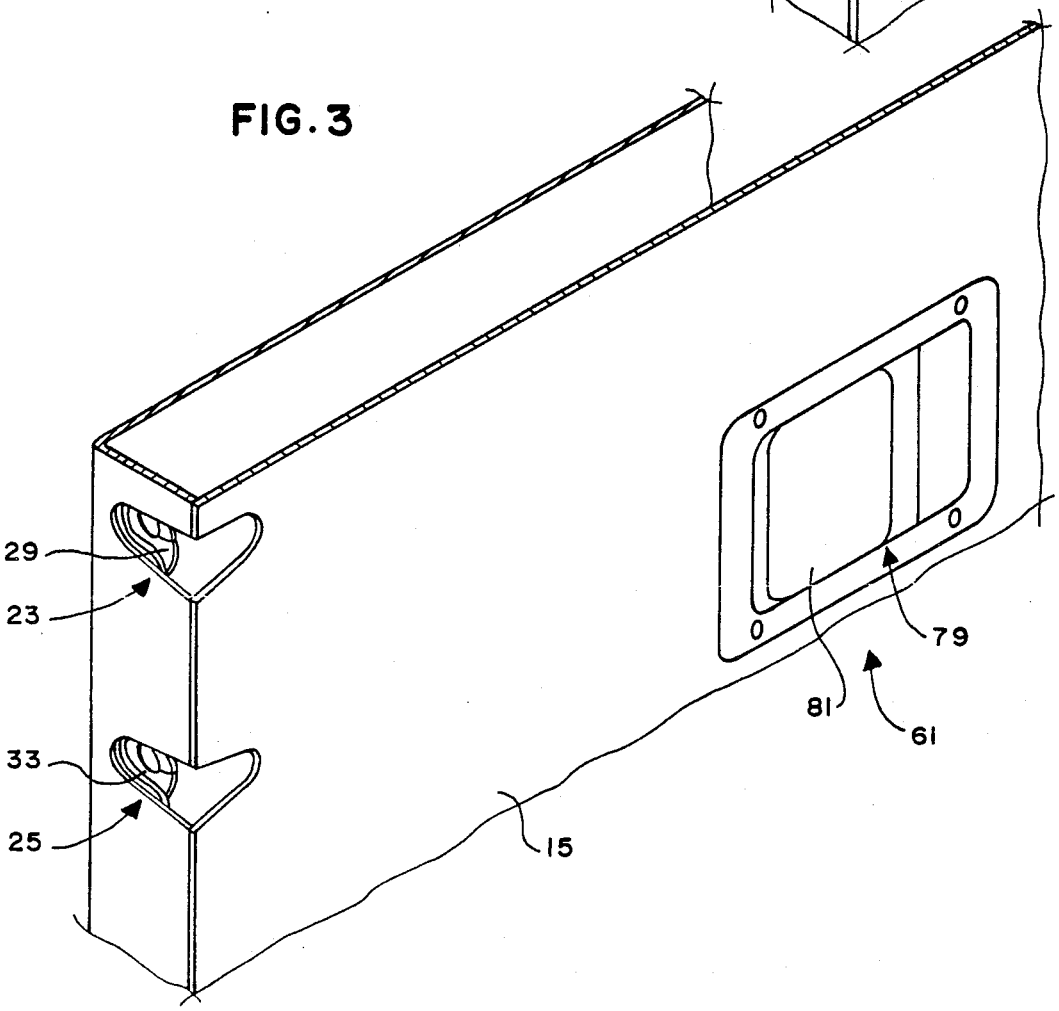
FIG. 3 is a perspective view of a portion of the security lock mechanism of the present invention showing a portion of the second structure and the first and second latch means.
Figure 5:
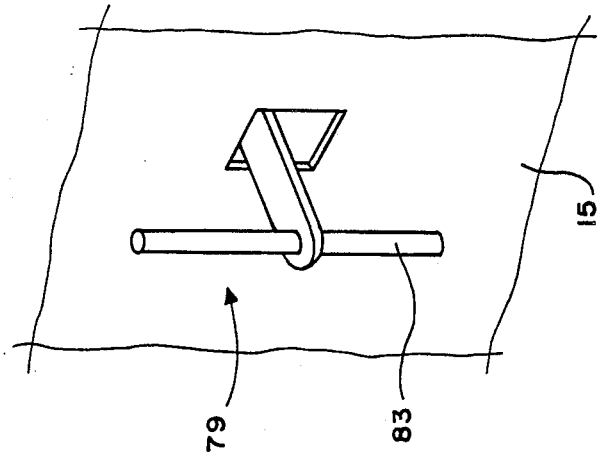
FIG. 5 is a perspective view of the security lock mechanism of the present invention showing a portion of the second structure and the release means.

The lock mechanism 11 preferably includes release means 61 coupled to the latch arm means 29, 33 of the first and second latch means 23, 25 for allowing one person within the controlled space 17 to simultaneously unlock the first and second latch means 23, 25 from the first and second latch members 19, 21. The release means 61 preferably includes a first link mechanism or rod 63 coupled to the latch arm means 29 of the first latch means 23 for moving the latch arm means 29 of the first latch means 23 to the completely unlocked position. The first link rod 63 preferably has a first end 65 coupled to the trigger portion 30 whereby movement of the first link rod 63 in the direction of the arrow 67 in FIG. 7 will cause the trigger portion 30 of the latch arm means 29 of the first latch means 23 to pivot in the direction of the arrow 59 in FIG. 7 causing the first latch means 23 to move between the completely locked and the completely unlocked positions as will now be apparent to those skilled in the art. The first link rod 63 preferably has a second end 69. The release means 61 preferably includes a second link mechanism or rod 71 coupled to the latch arm means 33 of the second latch means 25 for moving the latch arm means 33 of the second latch means 25 to the completely unlocked position. The second link rod 71 preferably has a first end 73 coupled to the trigger portion 34 of the latch arm means 33, whereby movement of the second link rod 71 in the direction of the arrow 75 in FIG. 6 will cause the trigger portion 34 of the latch arm means 33 of the second latch means 25 to pivot in the direction of the arrow 47 in FIG. 6 causing the second latch means 25 to move between the completely locked and the completely unlocked positions as will now be apparent to those skilled in the art. The second link rod 71 preferably has a second end 77. The lock mechanism 11 is designed so that the release means 61 will move the first and second latch means 23, 25 to the completely unlocked position only if the latch arm means 29, 33 of the first and second latch means 23, 25 are simultaneously moved to the completely unlocked position. In order to facilitate this simultaneous movement, the release means 61 preferably includes a single handle means 79 coupled to the second ends 69, 77 of both link rods 63, 71. The handle means 79 preferably includes a grip member 81 pivotally attached to the second structure 15 within the controlled space 17 (see FIG. 3), and preferably includes a connecting bar 83 (see FIG. 5) for engaging the second ends 69, 77 of each link rod 63, 71 to move the link rods 63, 71 in the direction of the arrows 67, 75 in FIGS. 6 and 7 when the grip member 81 is moved as will now be apparent to those skilled in the art.

While the specific construction of the lock mechanism 11 may vary as will now be apparent to those skilled in the art, the basic lock mechanism 11 will allow a single person to open both latch means 23, 25 from inside the controlled space 17 via the release means 61. However, the present invention requires the simultaneous efforts of two persons to open both latch means 23, 25 from outside the controlled space. More specifically, one persons must activate the adjacent control means 36 from a position adjacent but outside the controlled space 17 while another person must simultaneously activate the remote control means 37 from a position remote from the controlled space 17, as will now be apparent to those skilled in the art. Since both control means 36, 37 must be activated simultaneously, access into the controlled space cannot be obtained by a single person outside the controlled space 17 even if one of the control means 36, 37 has been left in an activated or open position.

Although the present invention has been described and illustrated with respect to a preferred embodiment and a preferred use therefor, it is not to be so limited since modifications and changes can be made therein which are within the full intended scope of the invention.

I claim:

1. A security lock mechanism for locking first and second structures to one another to define a controlled space on one side of said first and second structures and for requiring the simultaneous efforts of two persons to unlock said security lock mechanism from locations outside said controlled space, said lock mechanism comprising:

(a) a first latch member attached to said first structure;

(b) a second latch member attached to said first structure;

(c) first latch means attached to said second structure for being locked to said first latch member;

(d) second latch means attached to said second structure for being locked to said second latch member; and (e) control means for unlocking said first and second latch means from said first and second latch members; said control means including first control means for being activated from a location adjacent but outside said controlled space and including second control means for being activated from a location remote from said controlled space; said control means unlocking said first and second latch means from said first and second latch members only if said first and second control means are activated simultaneously.

2. A security lock mechanism for locking first and second structures to one another to define a controlled space on one side of said first and second structures and for requiring the simultaneous efforts of two persons to unlock said security lock mechanism from locations outside said controlled space, said lock mechanism comprising:

(a) a first latch member attached to said first structure;

(b) a second latch member attached to said first structure;

(c) first latch means attached to said second structure for being locked to said first latch member; said first latch means including a body attached to said second structure, and including latch arm means pivotally attached to said body for movement between a completely locked position in which said first latch means is locked to said first latch member and a completely unlocked position in which said first latch means is free from said first latch member;

(d) second latch means attached to said second structure for being locked to said second latch member; said second latch means including a body attached to said second structure, and including latch arm means pivotally attached to said body for movement between a completely locked position in which said second latch means is locked to said second latch member and a completely unlocked position in which said second latch means is free from said second latch member; and (e) control means for unlocking said first and second latch means from said first and second latch members; said control means including first control means for being activated from a location adjacent but outside said controlled space and including second control means for being activated from a location remote from said controlled space; said control means unlocking said first and second latch means from said first and second latch members only if said first and second control means are activated simultaneously.

3. The security lock mechanism of claim 2 in which is included release means coupled to said latch arm means of said first and second latch means for allowing one person within said controlled space to simultaneously unlock said first and second latch means from said first and second latch members.

4. The security lock of claim 3 in which said release means includes a first link mechanism coupled to said latch arm means of said first latch means for moving said latch arm means of said first latch means to said completely unlocked position, and includes a second link mechanism coupled to said latch arm means of said second latch means for moving said latch arm means of said second latch means to said completely unlocked position only if said latch arm means of said first latch means is simultaneously moved to said completely unlocked position.

5. The security lock mechanism of claim 2 in which said first control means includes a key operated lock coupled to said latch arm means of said second latch means for being activated from a position adjacent but outside said controlled space and for causing said latch arm means of said second latch means to move between said completely locked position and said completely unlocked position.

6. The security lock mechanism of claim 5 in which said second control means of said control means includes a solenoid means coupled to said latch arm means of said first latch means for being activated from a position remote from said controlled space and for causing said latch arm means of said first latch means to move between said completely locked position and said completely unlocked position.

7. The security lock mechanism of claim 6 in which said first control means includes an extension arm member coupled to said latch arm means of said second latch means and includes a flapper member coupled to said key operated lock and said extension arm member thereof; operation of said key operated lock causing said flapper member to pivot between a first position and a second position; pivotal movement of said flapper member to said second position causing said extension arm member of said first control means to move from a first position to a second position, movement of said extension arm member of said first control means to said second position causing said latch arm means of said second latch means to move to said completely unlocked position.

8. The security lock mechanism of claim 7 in which said second control means includes an extension arm member coupled to said latch arm means of said first latch means and in which said solenoid means of said second control means includes a rod member coupled to said extension arm member thereof; operation of said solenoid means causing said rod member thereof to move between a first position and a second position, movement of said rod member of said solenoid means to said second position causing said extension arm member of said second control means to move from a first position to said second position, movement of said extension arm member of said second control means to said second position causing said latch arm means of said first latch means to move to said completely unlocked position.

* * * * *